US005857791A

United States Patent [19]

Kenney

[11] Patent Number: 5,857,791

[45] Date of Patent: Jan. 12, 1999

[54] PRINT HOLDER

[76] Inventor: Richard E. H. Kenney, 224 Earl Stewart Dr., Aurora, Canada, L4G 6S5

[21] Appl. No.: 943,133

[22] Filed: Oct. 3, 1997

[30] Foreign Application Priority Data

Oct. 3, 1996 [CA] Canada ..... 2187057

[51] Int. Cl.[6] ..... B41J 11/62

[52] U.S. Cl. ..... 400/718; 400/717; 40/661; 40/649

[58] Field of Search ..... 400/718, 716, 400/717; 40/661, 649, 765, 771, 781

[56] References Cited

U.S. PATENT DOCUMENTS

| | | | |
|---|---|---|---|
| D. 105,417 | 7/1937 | Simon | D6/310 |
| D. 233,874 | 12/1974 | Ashley . | |
| D. 249,766 | 10/1978 | Munn . | |
| D. 263,319 | 3/1982 | Shuman . | |
| D. 263,964 | 4/1982 | Butman . | |
| D. 313,050 | 12/1990 | Burgess . | |
| D. 325,048 | 3/1992 | Penner . | |
| D. 333,163 | 2/1993 | Mendelsohn | D20/40 |
| D. 350,566 | 9/1994 | Pearson | D20/40 |
| D. 352,176 | 11/1994 | McMillan . | |
| D. 370,355 | 6/1996 | Kenney | D6/314 |
| D. 380,235 | 6/1997 | Gruneisen, III . | |
| 2,297,285 | 9/1942 | Bledsoe . | |
| 2,409,814 | 10/1946 | Vargish . | |
| 2,434,860 | 1/1948 | Oxley . | |
| 2,807,369 | 9/1957 | Stark . | |
| 3,086,658 | 4/1963 | Palmer | 211/50 |
| 3,452,463 | 7/1969 | Chaput . | |
| 3,820,262 | 6/1974 | Dewsnap | 40/661 |
| 3,836,419 | 9/1974 | Hamberger . | |
| 3,956,837 | 5/1976 | Itano | 40/152.1 |
| 3,974,694 | 8/1976 | Eberle et al. | 73/272 |
| 4,165,572 | 8/1979 | Sussman | 40/661 |
| 4,215,497 | 8/1980 | Levy . | |
| 4,229,892 | 10/1980 | Hueter et al. . | |
| 4,271,618 | 6/1981 | Lyman | 40/152 |
| 4,384,416 | 5/1983 | Kanzelberger . | |
| 4,442,617 | 4/1984 | Frye et al. . | |
| 4,496,127 | 1/1985 | Nelson . | |
| 4,594,802 | 6/1986 | Field | 40/10 D |
| 5,110,392 | 5/1992 | Ito et al. | 156/314 |
| 5,222,315 | 6/1993 | Lovison . | |
| 5,390,437 | 2/1995 | Pearson | 40/661 |
| 5,456,033 | 10/1995 | Sachnoff | 40/649 |
| 5,537,767 | 7/1996 | Schneider et al. | 40/661 |
| 5,640,790 | 6/1997 | Johns | 40/324 |

FOREIGN PATENT DOCUMENTS

| | | |
|---|---|---|
| 8717449 | 4/1989 | Germany . |
| 568168 | 8/1945 | United Kingdom . |

OTHER PUBLICATIONS

Instachange Displays Limited, "Plastic Menu & Sign Holders, Table Tents", Instachange Display Buyer's Guide & Price List, 1992, p. 18.

Burnes of Boston—1983, #8181 Frame left rear.

*Primary Examiner*—Edgar Burr
*Assistant Examiner*—Anthony H. Nguyen
*Attorney, Agent, or Firm*—Ridout & Maybee

[57] ABSTRACT

A print holder has two molded transparent plastic pieces united together each with an upright portion and a base having an inclined flank extending downwardly outwardly from a lower portion of the upright portion. A central portion of the upright portion of one or both pieces is recessed inwardly to define a pocket having an upper opening, for holding print material. The base portions together form a hollow base for capturing an inverted V-shaped printed information carrier that has wings extending adjacent the inclining flanks of the base. This allows display of information through the inclined flanks without requiring printing on the plastic.

14 Claims, 2 Drawing Sheets

PRINT HOLDER

FIELD OF THE INVENTION

This invention relates to an improved plastic print holder for displaying print material. In particular, this invention relates to a plastic print holder having an upright portion for displaying print material, and a base portion for displaying advertising copy, a trade-mark, logo or the like.

BACKGROUND OF THE INVENTION

Known print holders for holding a sheet in an upright position often include an auxiliary downwardly outwardly inclined display portion adjacent the base. This portion can often be more easily viewed from certain angles, for example by those seated at a table or adjacent a counter on which the print holder rests.

Known print holders of which the applicant is aware have required printing, for example screen printing, directly on portions of the plastic that are to be formed into an inclined base portion, and this printing operation is time consuming and expensive.

SUMMARY OF THE INVENTION

In the present invention, there is provided a print holder comprising first and second molded transparent plastic pieces each comprising a generally planar upright portion and a base portion having a lower side extending downwardly outwardly from a lower portion of the upright portion; said pieces being permanently united together at least along portions extending along their side edges, the base portions defining together a hollow base and receiving a printed information carrier comprising an inverted V-shape having wings extending adjacent the inclining flanks of the base; and a central portion of the upright portion of at least one of the pieces being recessed inwardly to define with the other piece a pocket having an upper opening at an upper end of the print holder.

With the present invention, the information carrier may be in the form of, for example, a printed paper insert, eliminating the need to print directly onto the plastic, and greatly lowering printing costs. The inserts may for example be printed in the form of a sheet bearing multiple copies which are then separated, for example by die cutting, and folded and inserted into the plastic holder before assembly of the two pieces together.

BRIEF DESCRIPTION OF THE DRAWINGS

An example of a preferred form of print holder is illustrated in the accompanying drawings, in which.

DESCRIPTION OF THE PREFERRED EMBODIMENT

Figure 1:
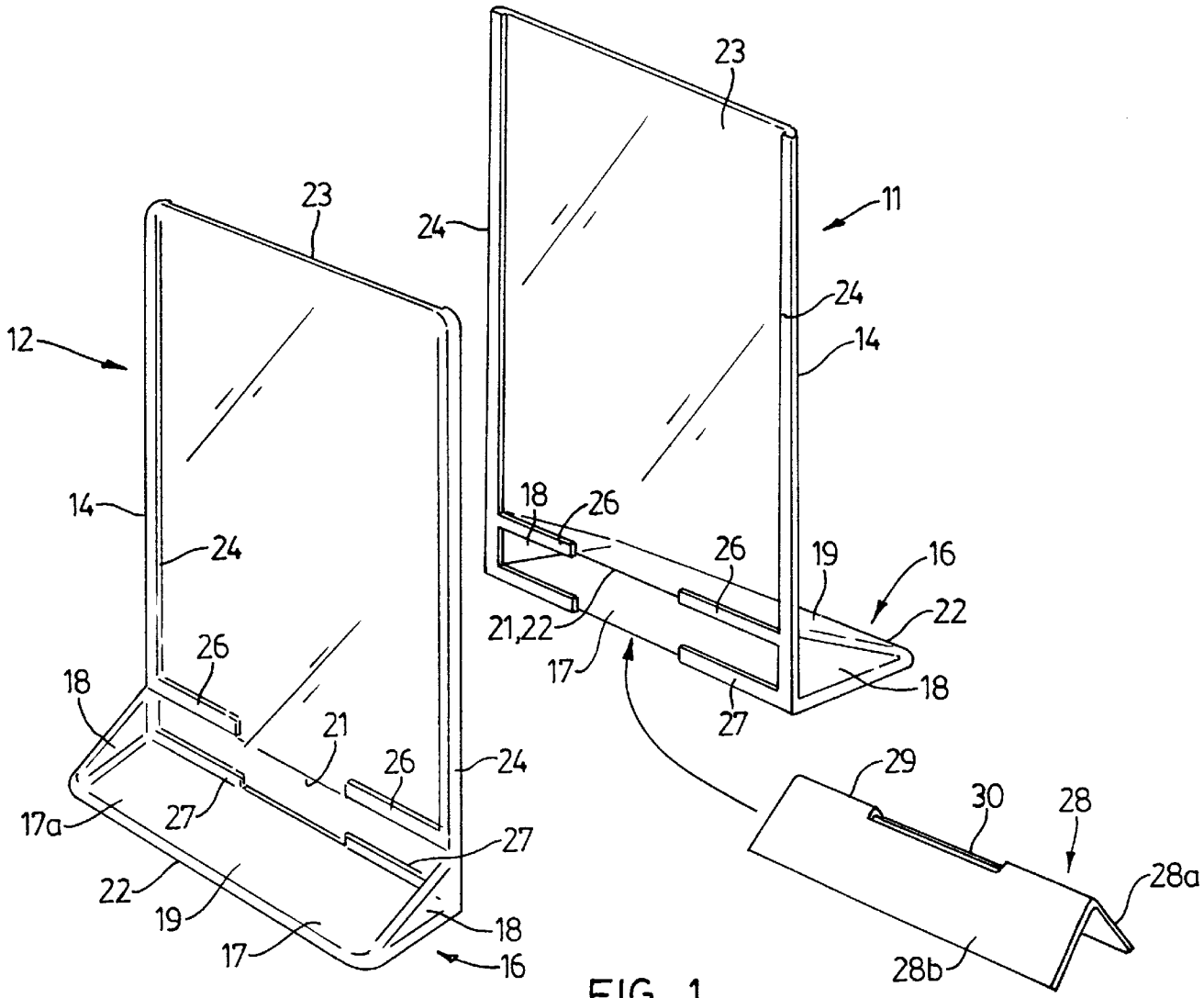
FIG. 1 is a perspective view showing two molded halves of a print holder ready for uniting together with the incorporation of a printed paper insert.

Referring to the drawings, wherein like reference numerals indicate like parts, the preferred form of print holder shown in the drawings comprises first and second molded transparent plastic pieces 11 and 12. Each piece comprises a generally planar upright portion 14 and a base portion 16 integrally molded with the upright portion 14.

The pieces 11 and 12 as shown are similar or identical, and are adapted to be molded by conventional plastics molding techniques, such as injection molding, in a common die cavity. More usually, a plurality, for example four or more of the pieces 11 and 12 are molded simultaneously using a die having a plurality of identical die cavities. The pieces 11 and 12 may for example be molded from any suitable highly transparent thermoplastic material, such as crystal polystyrene.

The outer face of each piece 11 and 12 has its edges and corners smoothly rounded.

Each base portion 16 is of hollow generally triangular form, and comprises a generally planar lower side 17, vertical side walls 18, and an inclining flank 19 extending downwardly outwardly from a lower edge 21 of the upright portion 14 toward a lower outer edge 22.

The inner face of each piece 11 or 12 is formed with a shallow recessed surface 23 which is defined between vertical raised edge portions 24 that extend continuously along each side edge of the pieces 11 and 12 and each merge at a lower intermediate portion with a raised intermediate edge portion 26 extending part way inwardly along the lower edge 21 of the upright portion 14.

The side edge portions 24 extend downwardly to the region of the lower side 17 of the base portion 16, and merge at their lower ends with a raised lower edge portion 27 that extends part way inwardly along the inner edge of the lower side 17.

To form the finished print holder, the pieces 11 and 12 are placed together with the raised edge portions 24, 26 and 27 on each piece in registry and the engaging edge portions are permanently united together, for example by adhesive bonding or welding. Preferably, the pieces are united by application of a cyanocrylate adhesive or by ultrasonic welding.

Before uniting the pieces together, a rectangular card or paper piece in the form of a printed information carrier or insert, 28 is inserted into the hollow base portion 16.

The insert 28 may be a rectangular piece die cut from a sheet carrying multiple representations of advertising copy, a trade-mark, logo or the like. The pieces are folded centrally along a fold line 29 to provide a tent like insert comprising an inverted V shape with the printed material on the upper side of the limbs 28*a* and 28*b*. Desirably, a central portion of the insert 28 is cut away to provide a rectangular slot 30. The insert 28 is inserted into the base portion 16 by inserting each limb 28*a* and 28*b* of the insert 28 into an opening defined between the lower edge 21 of the upright portion 14 and the lower side 17 of the base portion 16.

Figure 3:
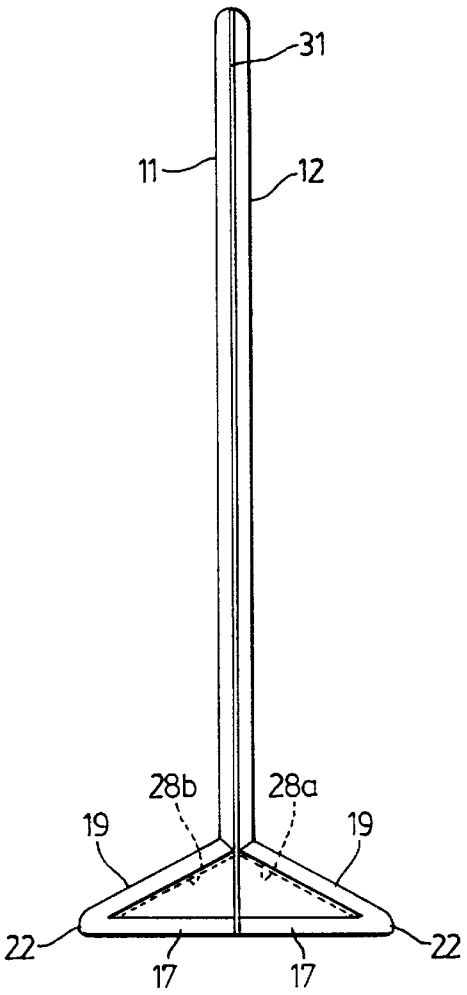
FIG. 3 is a vertical cross section through a longitudinal median of the completed print holder.

In the assembled condition, the base portions 16 form a generally prismatic hollow section, as seen in cross section in FIG. 3, and preferably, the limbs 28*a* and 28*b* are of a length and width such that they are snugly captured within the prismatic hollow space and are therefore lodged firmly within the base portion 16 of the completed print holder with the upper faces of the limbs 28*a* and 28*b* retained immediately beneath the inclining flanks 19 through which the printed material may be readily viewed.

It is also desirable if the insert 28 is formed from a transparent sheet material, preferably having an index of refraction similar to that of the plastic material comprising the base portion 16, and the limbs 28*a* and 28*b* extend the full length of the base portion 16 between the inner faces 18*a* and 18*b* of the vertical walls 18, and the full width of the inclining flank 19 between the lower edge 21 and the upper face 17*a* of the lower side 17. Therefore, when the insert 28 is inserted into the base portions 16 in the manner described above, the transparent sheet comprising the insert 28 will be invisible and the advertising copy carried on the limbs 28*a* and 28*b* will appear to be printed or etched directly onto the inclining flanks 19.

In the assembled condition, the recessed surfaces 23 together define a pocket 31 that has a relatively long upper opening 32 defined between the edge portion 24.

The raised intermediate edge portions 26 in the assembled condition define between them an intermediate opening 33 communicating between the pocket 31 and the interior of the hollow prismatic base structure, while the lower raised edge portions 27 define between them an opening 34 aligned with the intermediate opening 33 and of similar length.

The slot 30 in the insert 28 is preferably of length equal to or slightly greater than the length of the intermediate opening 33 and is positioned so that it is aligned with the opening 33 in the assembled condition.

Figure 2:
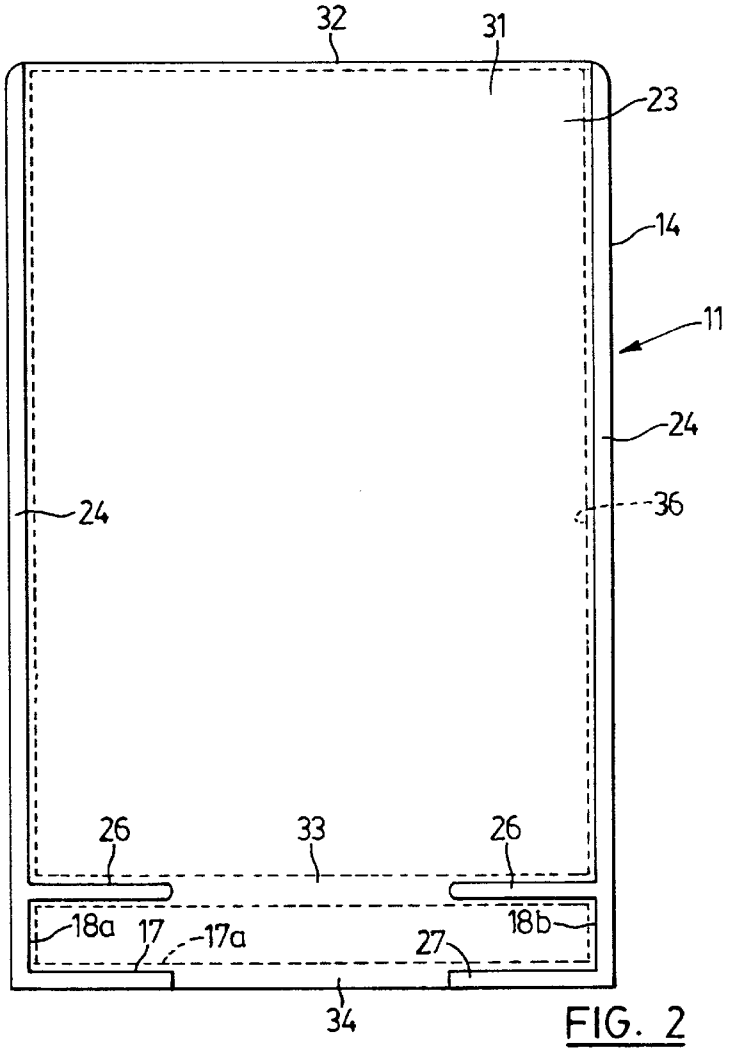
FIG. 2 is a side view of one half of the holder of FIG. 1.

The pocket 31 may be used to receive a card 36 or like sheet material shown in broken lines in FIG. 2 of substantially the width of the upper opening 32 and which, in the display position, rests on the upper edges of the raised intermediate edge portions 26. The card 36 or like sheet material within the pocket 31 may carry advertising and informational material, for example, and normally is retained positively and is not easily not easily removed, assuming the depth of the pocket 31 is greater than the length of the card 36 and the upper edge of the card or sheet material 36 is below the upper edge of the united pieces 11 or 12.

In a manner similar to that described in applicant's copending U.S. patent application Ser. No. 08/203,300, to which reference may be made for further details, a card 36 of the like lodged within the print holder may be removed by inserting a thin bladed tool, such as a business card or knife blade upwardly through the openings 34, 30 and 33 to engage the card 36 and dislodge it upwardly.

The width of the pocket 31, that is the distance between the two opposed recessed surfaces 23 in the assembled condition, is preferably quite small so that the pocket 31 will snugly receive one or two thicknesses of standard card stock.

I claim:

1. A print holder, comprising:

separate first and second molded transparent plastic pieces each comprising a generally planar upright portion and a base portion;

an inner face of the upright portion of at least one of the pieces having a raised edge portion on a side edge that is connected to an inner face of the other of said pieces and defining therewith a side of a pocket having an upper opening extending across an upper end of the print holder;

said base portion of each piece comprising an inclining flank portion integrally formed with and extending downwardly outwardly from a lower edge of the upright portion to a lower edge portion, said lower edge portions of said connected together first and second pieces together defining a lower general base plane on which the holder may rest on a plane surface;

each base portion of each piece further comprising a lower flange portion extending transversely adjacent said lower general base plane and adjacent each lower edge portion of the flank portion; and the base portions receiving a printed information carrier comprising an inverted V-shape having wings extending adjacent the inclining flank portions of the base portions, and said lower edges engaged by said transversely extending lower flange portions.

2. A print holder as claimed in claim 1, wherein each lower flange portion extends inwardly to an inner edge substantially coplanar with an inner side of said raised edge portion.

3. A print holder as claimed in claim 2, wherein the inner face of each upright portion has a lower raised edge portion adjacent said lower edge, said lower raised edge portions of said first and second pieces together defining an intermediate opening at a lower edge of said pocket that is shorter than said upper opening, the inner edge of each said lower flange portion includes a recess defining a lower opening, and an apex portion of the V-shape carrier includes an opening in vertical alignment with said intermediate and lower openings.

4. A print holder as claimed in claim 1 wherein the pocket is adapted to snugly receive one or two thicknesses of standard card stock.

5. A print holder as claimed in claim 1 wherein each base portion comprises a pair of opposite ends, and each wing extends the full length of the base portion between the opposite ends and the full width of the inclining flank.

6. A print holder as claimed in claim 1 wherein at least one of the wings carries printed information.

7. A print holder as claimed in claim 1 wherein the printed information carrier comprises a transparent sheet.

8. A print holder as claimed in claim 7 wherein the plastic pieces have an index of refraction, and the transparent sheet has an index of refraction similar to that of the plastic pieces.

9. A print holder as claimed in claim 1 wherein the plastic pieces are injection molded.

10. A print holder as claimed in claim 1 wherein the plastic pieces are injection molded from crystal polystyrene.

11. A print holder as claimed in claim 1 wherein the plastic pieces are permanently united through adhesive bonding.

12. A print holder as claimed in claim 11 wherein the bonding is cyanocrylate adhesive bonding.

13. A print holder as claimed in claim 1 wherein the plastic pieces are permanently united through welding.

14. A print holder as claimed in claim 13 wherein the welding is ultrasonic welding.

* * * * *